United States Patent [19]

McGaha

[11] Patent Number: 4,639,327

[45] Date of Patent: Jan. 27, 1987

[54] COMPOSITION AND METHOD FOR CLEANING PAINTED SURFACES

[76] Inventor: Larry E. McGaha, P.O. Box 21, Clinton, Mont. 59825

[21] Appl. No.: 746,783

[22] Filed: Jun. 20, 1985

[51] Int. Cl.[4] ..... C11D 7/08; C11D 7/50

[52] U.S. Cl. ..... 252/143; 252/170; 252/172; 252/174.18; 252/DIG. 8; 134/38; 134/39; 134/40; 134/41

[58] Field of Search ..... 134/26, 38, 39, 40, 134/41, 2, 3; 252/170, 171, 172, 174.18, DIG. 8, 142, 143

[56] References Cited

U.S. PATENT DOCUMENTS

| | | | |
|---|---|---|---|
| 1,049,467 | 1/1913 | Ellis | 252/DIG. 8 |
| 1,067,600 | 7/1913 | Gardner | 252/DIG. 8 |
| 1,165,148 | 12/1915 | Birchall | 252/DIG. 8 |
| 1,516,064 | 11/1924 | Schmidt | 252/DIG. 8 |
| 3,505,112 | 4/1970 | Kettler | 134/2 |
| 3,679,592 | 7/1972 | Schomburg | 252/153 |
| 3,910,848 | 10/1975 | Froehlich | 252/90 |
| 4,028,261 | 6/1977 | Petersen | 252/89 R |

*Primary Examiner*—A. Lionel Clingman
*Assistant Examiner*—Hoa Van Le
*Attorney, Agent, or Firm*—William D. West

[57] ABSTRACT

A composition and method for cleaning painted surfaces is disclosed. The invention provides a solution of a fixed oil such as linseed oil, an alcohol such as isopropyl alcohol, a drying agent and a carboxylic acid such as acetic acid. The method of applying the solution is to saturate a rubbing cloth with the solution, apply the saturated cloth to a weathered painted surface and remove the excess with a second absorbant cloth. The composition removes oxidation and renews the weathered painted surface. A pre-wash having the ingredients of the acid, the alcohol and water is also disclosed.

2 Claims, No Drawings

COMPOSITION AND METHOD FOR CLEANING PAINTED SURFACES

BACKGROUND OF THE INVENTION

1. Field of the Invention

The invention relates to a composition and method for cleaning painted surfaces, and in particular to a composition and method for renewing the painted weather surfaces of structures such as mobile homes and campers.

2. Discussion of the Technical Problems

Painted metal surfaces are used in many applications such as trailers, boats, campers, cars. Many of these surfaces are constantly exposed to the effects of sunlight and weather. It has been observed that most of the painted surfaces such as aluminum, steel, fiberglass and the like, eventually oxidize and lose their aesthetic appeal unless they have been constantly waxed or coated to maintain the original shine.

Few people bother to maintain a coating of wax on their trailer homes and campers so the effects of the sun and weather deteriorate the painted surface to a point where it is no longer attractive and eventually loses its value.

A surface can be repainted but the cost and complexity of matching the original colors is usually too great for many owners. Accordingly, the need exists for a cleaning solution that when applied to painted surfaces, renews the paint and provides a shine that approximates the original, does not cost too much and is easy to apply.

The ideal cleaning solution should not be harmful to the painted surface, should provide a thin protective film, and in the case of some painted surfaces should replace oils which have leached out due to the weather.

Prior-art compositions and methods for cleaning painted surfaces are generally of the type employing an abrasive material or compound that removes a portion of the surface substrate. After the surface has been abraded and the cleaning compound removed, a wax coating is applied to protect the surface. The prior-art methods thus require at least three separate steps to achieve a renewed surface.

No known prior-art composition and method for cleaning painted surfaces provides a composition that can be applied in a single operation and yet both cleans and leaves a long-lasting protective film.

While no known examples of compositions and their methods of use for cleaning painted surfaces in a single operation have been discovered, U.S. Pat. No. 3,679,592 issued to Schomburg teaches a cleaning and soil preventive composition for cleansing hard surfaces such as porcelain and enamel and inhibiting the deposition of soils or stains thereon.

Compositions and methods for cleaning masonry, tile, grout and textiles have been discovered. Examples of such compositions and methods can be found in U.S. Pat. Nos. 4,028,261 to Petersen et al., 3,505,112 to Kettler, and 3,910,848 to Froehlich et al.

None of the compositions or methods discovered provide for the cleaning of painted surfaces and none known use the same ingredients or process steps.

Accordingly, a need exists for a composition and method for cleaning painted surfaces that would provide a safe cleaning solution that when applied to painted surfaces, does not harm the surface, renews the paint and can be applied in a single operation. The instant invention is directed to all of these needs as well as to others.

SUMMARY OF THE INVENTION

It is a feature of the invention to provide a composition and method for cleaning painted surfaces.

It is another feature of the instant invention to provide a composition for cleaning painted surfaces having the ingredients of a fixed oil, an alcohol, and a carboxylic acid.

It is another feature of the instant invention to provide a composition for cleaning painted surfaces having the ingredients of linseed oil, isopropyl alcohol, acetic acid and a drying agent.

It is another feature of the instant invention to provide a composition for cleaning painted surfaces having the ingredients of linseed oil, isopropyl alcohol, and vinegar.

It is another feature of the instant invention to provide a composition for cleaning painted surfaces having the ingredients of linseed oil, isopropyl alcohol, and lemon juice.

It is a still further feature of the invention to provide a method of applying a solution having the ingredients of a fixed oil, an alcohol, and a carboxylic acid by saturating a rubbing cloth with the solution, applying the saturated cloth to a weathered painted surface and removing the excess solution with a second absorbant cloth.

It is yet a further feature of the invention to provide a pre-wash solution having the ingredients of acetic acid and isopropyl alcohol.

These and other features and objects are attained according to the instant invention by providing a liquid cleaning solution of a fixed oil such as linseed oil, an alcohol such as isopropyl alcohol, and a carboxylic acid such as acetic acid. The method of applying the solution is to saturate a rubbing cloth with the solution, apply the saturated cloth to a weathered painted surface and remove the excess with a second absorbant cloth. A pre-wash having the ingredients of water, an acid and an alcohol is also provided and can be used prior to the application of the cleaning solution to the painted surface.

DESCRIPTION OF THE PREFERRED EMBODIMENT

All of the individual ingredients of the compositions of this invention are available commercially and are made by well-known methods. The cleaning solution of the invention is prepared by mixing the ingredients in any order.

The solution can be illustrated by the following examples which do not limit the invention.

EXAMPLE 1

| | Percent |
|---|---|
| linseed oil | 47.00 |
| 70% isopropyl alcohol | 47.00 |
| acetic acid | 6.00 |
| Total ingredients | 100.00 |

EXAMPLE 2

| | Percent |
|---|---|
| linseed oil | 45.00 |
| isopropyl alcohol | 45.00 |
| acetic acid | 5.00 |
| drying agent | 5.00 |
| Total ingredients | 100.00 |

The acid used in the examples is acetic acid however nearly any carboxylic acid would work equally as well. The acetic acid can be provided by a common source such as lemon juice or vinegar. The drying agent is unnecessary to the successful use of the solution but does speed the drying time. Any drying agent could be used and an example of a successfully used agent is a commercially available agent known as Japan Dryer.

A pre-wash to remove the most stubborn oxidation can be made with equal parts of water, alcohol and acid. The pre-wash is applied by rubbing the surface with a cloth saturated with the pre-wash solution. It is to be understood that it is not necessary to the successful practice of the invention to use a pre-wash as the cleaning solution will remove all but the worst stains and oxidation.

The linseed oil is an example of a fixed oil or nonvolatile oil and provides a protective film which also replaces the oil in the paint film. It is contemplated that any other fixed oil such as Tung oil or sunflower oil would work equally as well in the solution.

In order to apply the cleaning solution, one simply saturates a soft cloth with the solution and then applies it to the surface to be treated. A second cloth is then immediately rubbed on the surface to remove the oxidation and stains. A very light film of the solution remains on the surface.

It should be noted that additional ingredients such as coloring agents and odor masking scents can be added to improve the color and scent of the solution and the pre-wash. Specifically, it has been found that camphor and oil soluble colors are well suited to be added to the solution.

Although specific ingredients, applications, materials, components, sequences of events, and methods have been stated in the above description of the preferred embodiment of the invention, other suitable materials, other applications, ingredients and process steps as listed herein may be used with satisfactory results and varying degrees of quality. In addition, it will be understood that various other changes in details, ingredients, materials, steps, and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A liquid cleaning composition for cleaning painted surfaces comprising:

i. 10 to 90 parts of a fixed oil taken from the group consisting of linseed oil, tung oil and sunflower oil, ii. 10 to 90 parts of an alcohol taken from the group consisting of methanol, ethanol and isopropyl alcohol, iii. 1 to 5 parts of a carboxylic acid, the total of (i), (ii) and (iii) being 100 parts.

2. The composition according to claim 1 further comprising from 1 to 10 parts of a drying agent, the total of the ingredients being 100 parts.

* * * * *